US005888011A

United States Patent [19]

Reinbold, Jr.

[11] Patent Number: 5,888,011

[45] Date of Patent: Mar. 30, 1999

[54] LOOSE- LEAF BINDER STRUCTURE

[75] Inventor: Frederick I. Reinbold, Jr., Grand Prairie, Tex.

[73] Assignee: Williamson Printing Corporation, Dallas, Tex.

[21] Appl. No.: 833,977

[22] Filed: Apr. 11, 1997

[51] Int. Cl.[6] ..... B42F 3/00

[52] U.S. Cl. ..... 402/70; 402/73; 402/79; 402/80 R

[58] Field of Search ..... 402/79, 80 R, 402/70, 73, 4, 501, 20, 25

[56] References Cited

U.S. PATENT DOCUMENTS

| | | | |
|---|---|---|---|
| 788,241 | 4/1905 | Brandt . | |
| 879,135 | 2/1908 | Anderson . | |
| 1,027,523 | 5/1912 | Buchan | 402/501 |
| 1,037,292 | 9/1912 | Morden | 402/501 |
| 1,086,495 | 2/1914 | Wigginton . | |
| 2,368,162 | 1/1945 | Scholfield . | |
| 3,208,457 | 9/1965 | Zippel . | |
| 3,351,065 | 11/1967 | Roush | 129/18 |
| 4,307,972 | 12/1981 | Errichiello | 402/73 |
| 4,551,039 | 11/1985 | Basseches | 402/501 X |
| 4,577,985 | 3/1986 | Beyer | 402/22 |
| 4,607,970 | 8/1986 | Heusinkveld | 402/20 |
| 4,941,804 | 7/1990 | Sarpy, Jr. | 402/80 R X |
| 5,015,114 | 5/1991 | Miller | 402/4 |
| 5,028,159 | 7/1991 | Amrich et al. | 402/20 |
| 5,180,246 | 1/1993 | Hightower | 402/20 |
| 5,524,997 | 6/1996 | von Rohrscheidt | 402/19 |
| 5,553,959 | 9/1996 | Feldman et al. | 402/79 |
| 5,716,153 | 2/1998 | Aiello | 402/46 |
| 5,749,667 | 5/1998 | Feldman et al. | 402/79 |

*Primary Examiner*—Frances Han
*Attorney, Agent, or Firm*—Jones, Day, Reavis & Pogue

[57] ABSTRACT

A binder for containing a plurality removable paper sheets and having a back portion with covers attached to each side thereof and an elongated spine portion attached to the inside of the back portion with a plurality of binder rings integrally formed with the elongated spine to form a single unit. The annular rings have an outer portion of a first width and an inner portion of a second smaller width that matingly engages die-cut recesses in each sheet that likewise have a first narrow portion extending inwardly from the edge of the sheet to a second portion having a greater width than the first narrow portion such that the paper sheets can be inserted and removed from attachment to the binder rings.

11 Claims, 2 Drawing Sheets

LOOSE- LEAF BINDER STRUCTURE

BACKGROUND OF THE INVENTION

1. Field of the Invention

The present invention relates in general to a loose-leaf binder structure for containing removable pages and in particular relates to a loose-leaf binder structure in which binder rings are integrally formed with an elongated spine that is rigidly attached to and extends along the inner surface of an elongated back portion of a binder.

2. Description of Related Art Including Information Disclosed Under 37 CFR 1.97 and 1.98

There are many types of prior art binding devices that hold bound pages. Some of them are locking ring notebooks while others are spiral ring notebooks.

In U.S. Pat. No. 5,015,114, there is described a modular binder ring comprising a flat disk-shaped central portion having a first axial width and an aperture disposed substantially in the center thereof. An annular outer rim is formed on the periphery of the central portion. The annular rim includes an arcuately-shaped outer surface which is configured as the outer segment of a circle. A plurality of loose-leaf paper sheets with die-cut recesses proximate an outer edge thereof attach to at least two of the binder rings. The die-cut recesses are configured to loosely fit on the annular outer rims of the binder rings.

In U.S. Pat. No. 3,351,065, a loose-leaf binder structure is disclosed in which a pair of swingable covers and a back is provided with a plurality of spaced rings extending through openings in the cover for interlocking with a base element. A rib has a plurality of notches on the base and each ring includes a central web extending through the cover for receipt in a corresponding notch to the end web and rib. Thus the ring elements are secured to a base member through slots formed in the cover or back portion of the notebook so that the parts are releasably connected, thereby eliminating the need for conventional riveting or adhesive operations to secure the rings to the notebook binder.

In each of these cases, there is lacking a simple notebook having a binder with an elongated back portion with opposed longitudinal edges and a pair of cover portions hingedly attached to the longitudinal edges of the back portion for containing removable sheets of paper. It would be advantageous to have such a simple binder that could contain a plurality of removable sheets of paper.

SUMMARY OF THE INVENTION

Thus the present invention discloses a novel binder for a plurality of loose-leaf paper sheets that are removable therefrom. The binder has an elongated back portion with opposed longitudinal edges and has a pair of cover portions hingedly attached on the longitudinal edges of the back portion. An elongated rectangular spine is rigidly attached to and extends along the inner surface of the elongated back portion. At least two annular binder rings are integrally formed with the elongated rectangular spine for matingly engaging die-cut recesses in paper sheets to removably bind a plurality of the loose-leaf paper sheets to the elongated rectangular spine between the cover portions to form a notebook with loose-leaf paper sheets that can be removed and inserted.

In one embodiment, the binder rings are U-shaped with a semicircular upper portion joined or integrally formed with spaced apart parallel legs. The spaced apart parallel legs are integrally formed with the elongated rectangular spine.

In another embodiment, the die-cut recesses have a large portion with the outer shape of a mushroom joined by a smaller diameter rectangular portion.

Thus it is an object of the present invention to provide a binder for a plurality of loose-leaf paper sheets with the binder including an elongated back portion and a pair of cover portions hingedly attached thereto.

It is also an object of the present invention to provide an elongated rectangular spine that, in the preferred embodiment, is also generally rectangular in cross section, and that is rigidly attached to and extends along the inner surface of the elongated back portion.

It is still a further object of the present invention to provide at least two annular binder rings that are integrally formed with an elongated rectangular spine rigidly attached to the inside of a back portion of a notebook having a pair of cover portions hingedly attached thereto so that the at least two annular binder rings bind a plurality of loose-leaf paper sheets to the elongated rectangular spine between the cover portions.

Thus the present invention relates to a binder for a plurality of loose-leaf paper sheets of the kind having opposing edges, each sheet having at least two spaced, aligned, die-cut recesses extending inwardly a predetermined distance from one edge thereof, each die-cut recess having a first portion of a first width and a second portion of a smaller width. The binder comprises an elongated back portion with opposed longitudinal edges and having a pair of cover portions hingedly attached on the longitudinal edges of the back portion. The back portion and the cover portions each have an inner and an outer surface and an elongated spine is rigidly attached to and extends along the inner surface of the elongated back portion. At least two annular binder rings are integrally formed with the elongated spine and have essentially the same spacing as the die-cut recesses for matingly engaging the die-cut recesses and removably binding a plurality of loose-leaf paper sheets to the elongated spine between the cover portions to form a notebook with loose-leaf paper sheets that can be removed and/or inserted.

BRIEF DESCRIPTION OF THE DRAWINGS

These and other features of the present invention will be more fully disclosed when taken in conjunction with the following DETAILED DESCRIPTION OF THE PREFERRED EMBODIMENTS in which like numerals represent like elements and in which.

DETAILED DESCRIPTION OF THE PREFERRED EMBODIMENTS

Figure 1:
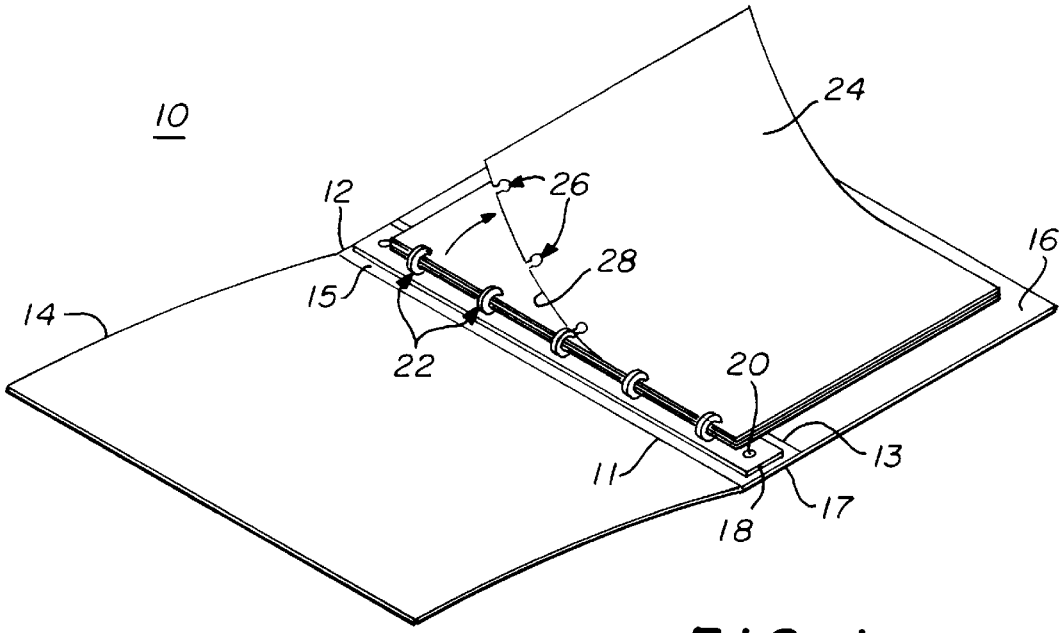
FIG. 1 is an isometric view of the novel binder of the present invention with the top cover opened to expose the removable loose-leaf pages therein.

FIG. 1 is an isometric view of the novel binder 10 of the present invention. It includes an elongated back portion 12 with opposed longitudinal edges 11 and 13 and having a pair of cover portions 14 and 16 hingedly attached to the longitudinal edges 11 and 13, respectively, of the back portion 12. The back portion 12 has inner and outer surfaces 15 and 17, respectively. An elongated spine 18 is rigidly attached to and extends along the inner surface 15 of the elongated back portion 12. It is generally rectangular in cross section although it could have other shapes. Rivets 20 or other fastening means rigidly attaches the elongated spine 18 to the back portion 12. The binder back portion 12 and hinged cover portions 14 and 16 may be formed of a variety of materials such as compressed paper, plastic, or the like.

At least two annular binder rings 22 are integrally formed with the elongated spine 18 and have the same spacing as the die-cut recesses 26 formed adjacent edge 28 in each removable paper sheet 24. Thus the annular binder rings 22 matingly engage the die-cut recesses 26 for removably binding the plurality of loose-leaf paper sheets 24 to the elongated rectangular spine 18 between the cover portions 14 and 16 to form notebook 10 with loose-leaf paper sheets 24 that can be removed and inserted.

It will be noted that the elongated rectangular spine 18 is substantially centered on the inside surface 15 of the binder back portion 12. It is to be understood, of course, that instead of attaching the elongated spine 18 to the back portion 12 with rivets 20, it could be fastened by other means, such as glue, to the inside surface 15 of the binder back portion 12.

Figure 2:
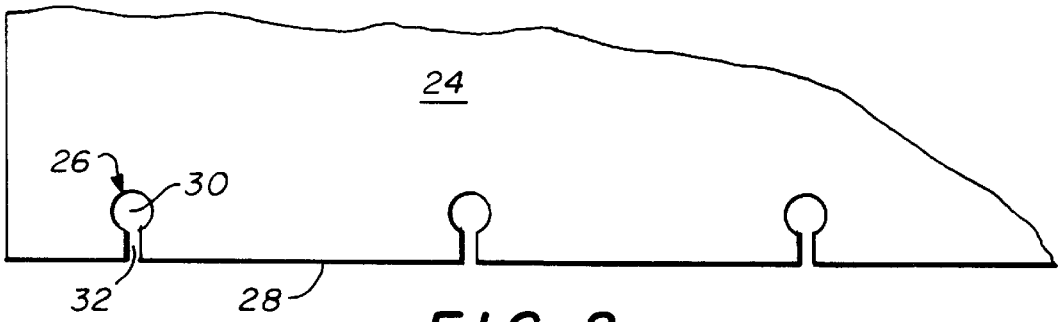
FIG. 2 is a portion of a paper sheet with die-cut recesses for insertion in the binder of FIG. 1.
Figure 7:
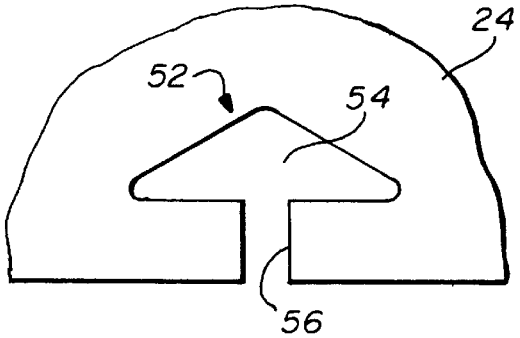
FIG. 7 is a portion of a paper sheet illustrating an alternate embodiment of the die-cut recesses.

FIG. 2 illustrates a portion of one of the removable pages 24 and illustrates the die-cut recesses 26 disposed adjacent edge 28 of each loose-leaf sheet of paper 24. As shown, each die-cut recess 26 is formed with a narrow region 32 that extends inwardly from edge 28 of the sheet of paper 24. It also has a circular region 30 that is wider than the narrow portion 32 and extends inwardly from the narrow portion 32. The shapes of narrow portion 32 and wider portion 30 of the die-cut recesses 26 can, of course, be varied as illustrated in FIG. 7 wherein the wider portion 54 of the die-cut recess 52 is generally mushroom, wedge, or pyramid shaped. The narrow portion 56 is generally rectangular in shape but could be other shapes.

Figure 3:
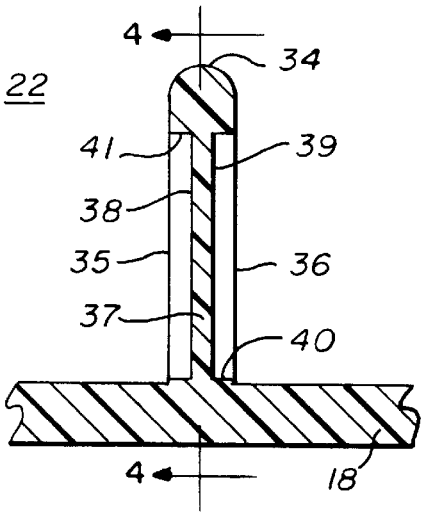
FIG. 3 is a cross-sectional view of one of the binder rings of the present invention shown to be integrally formed with the elongated spine that is attached to the back portion of the binder.

FIG. 3 is a cross-sectional view of one of the annular binder rings 22 that is integrally formed with the elongated spine 18. As can be seen in FIG. 3, the binder ring 22 has a disk-shaped central portion 37 having a first predetermined axial width determined by opposed surfaces 38 and 39. An outer annular portion 34 extends about the periphery of the central portion 37. Outer portion 34 is arcuately shaped as can be seen in FIG. 3 substantially in the form of a semicircle and has a second axial width, shown by edges 35 and 36, greater than the first axial width of the central portion 37. In the preferred embodiment, the binder ring 22 is integrally formed with the spine 18 from a molded synthetic material such as plastic. As can be seen in FIG. 1, the sheets 24 are detachably held on the binder rings 22 by sliding the outer portion 34 of the binder ring 22 through the narrow portion 32 of the die-cut recess 26 until the outer portion 34 of the binder ring engages the wider portion 30 of the die-cut recess and central portion 37 engages the narrower portion 32 of the recess 26. Thus the paper sheets are held on the binder rings 22 by the inner surfaces 40 and 41 of the outer portion 34 of binder ring 22 engaging the edges of the wide portion 30 of the die-cut recess. As can be seen in FIG. 1, the sheets of paper 24 may be easily removed or they may be turned from the flat position shown in FIG. 1 toward cover 14. Thus it can be seen in FIG. 3 that the outer diameter of the wide portion 34 of binder ring 22 extends from edge 35 to edge 36 while the diameter of the narrow portion 37 of the binder ring 22 extends from one surface 38 to the other surface 39.

Figure 4:
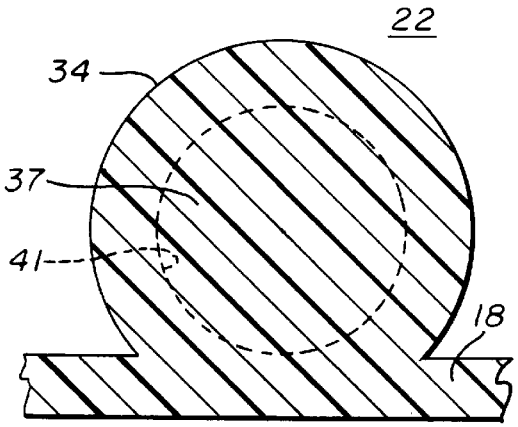
FIG. 4 is a cross-sectional view of the binder ring taken along lines 4—4 of FIG. 3.

FIG. 4 is a cross-sectional view of the binder ring 22 taken along lines 4—4 of FIG. 3. It can be clearly seen in this figure how the binder ring 22 is integrally formed with the spine portion 18. This construction allows a solid base, spine 18, rigidly formed with the binder rings 22 in an economical fashion such as by molding plastic and which, when attached to the inside of the back portion 12 of the notebook 10 as shown in FIG. 1, forms an economical and yet extremely useful loose-leaf notebook having front and back covers 14 and 16, respectively.

Figure 5:
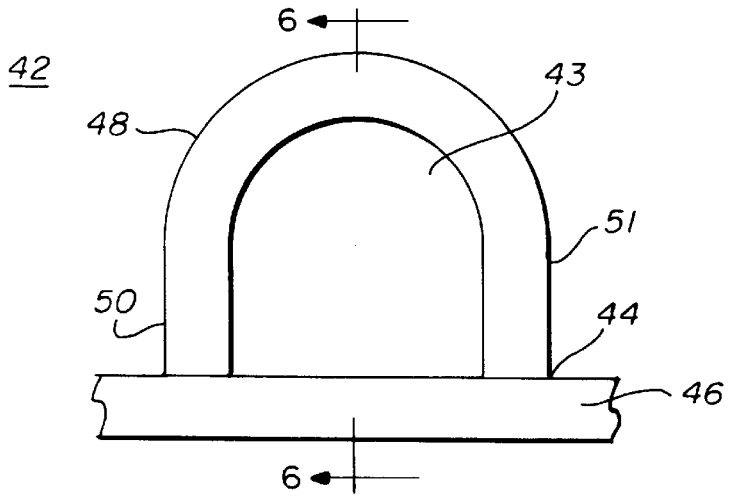
FIG. 5 is a front view of an alternate embodiment of a binder ring for use with the novel binder of the present invention.
Figure 6:
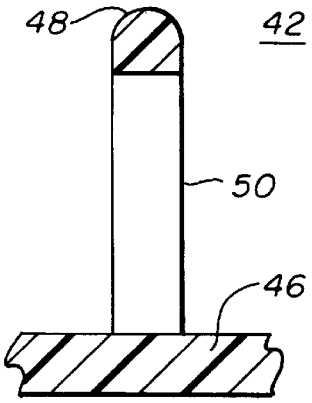
FIG. 6 is a cross-sectional view of the alternate binder ring taken along lines 6—6 of FIG. 5.

FIG. 5 and FIG. 6 illustrate an alternate embodiment of the binder ring of the present invention. As shown in FIG. 5, the binder ring 42 is comprised of a semicircular upper portion 48 integrally formed with spaced parallel legs 50 and 51. The legs 50 and 51 are integrally formed with the spine portion 46. With the use of straight parallel spaced legs 50 and 51 a right angle 44 is formed with the spine portion 46 thus enabling the pages to be more easily turned. The center portion 43 is open in this embodiment. However, if the plastic rings 42 are not sufficient to withstand side pressures without breaking, then a center portion can be integrally formed in the area 43 similar to that shown in FIG. 3 and FIG. 4 to strengthen the binder ring 42.

FIG. 6 is a cross-sectional view of the alternate binder ring 42 shown in FIG. 5 taken along lines 6—6.

Thus the present invention enables loose-leaf sheets of paper of various sizes to be bound by inserting an arbitrary number of binder rings into die-cut recesses provided on one side of the paper sheets. The pages of the notebook can be folded through 180° and can be moved very easily about the binder rings. Thus the invention permits the easy removal of individual pages by lifting the edge of the paper having the die-cut recesses away from the modular binder rings as discussed in the prior art and yet provides a notebook having a spine portion rigidly attached to the inner surface of the back portion of the notebook to form a notebook that can be economically and easily formed while providing all of the advantages of the prior art.

The corresponding structures, materials, acts, and equivalents of all means or step plus function elements in the claims below are intended to include any structure, material, or act for performing the function in combination with other claimed elements as specifically claimed.

I claim:

1. Binder for a plurality of loose-leaf paper sheets of the kind having opposing edges, each sheet having at least two spaced, aligned, die-cut recesses extending inwardly a predetermined distance from one edge thereof, each recess having a first portion of a first width and a second portion of a smaller width, the binder comprising:

an elongated back portion with opposed longitudinal edges;

a pair of cover portions hingedly attached on corresponding ones of the longitudinal edges of said back portion;

said back portion and the said cover portions each having an inner and an outer surface;

an elongated spine rigidly attached to and extending along the inner surface of the elongated back portion; and at least two annular one-piece binder rings integrally formed with said elongated spine and having the same spacing as said die-cut recesses for matingly engaging said die-cut recesses and removably binding said plurality of loose-leaf paper sheets to said elongated spine between said cover portions to form a notebook with loose-leaf paper sheets that can be removed and inserted.

2. A binder as in claim 1 wherein said elongated spine is substantially centered on the inside surface of said binder back portion.

3. A binder as in claim 2 wherein said elongated spine is glued to said inside surface of said binder back portion.

4. A binder as in claim 2 wherein said elongated spine is riveted to said inside surface of said binder back portion.

5. A binder as in claim 1 wherein each of said binder rings comprises:

an annular outer rim having a cross-sectional width substantially identical to said first portion width of the die-cut recesses in said loose-leaf paper sheets; and a disk-shaped center portion integrally formed with the annular outer rim and having a cross-sectional width substantially identical to the smaller width of said second portion of the die-cut recess, each said paper sheet being removably held to said spine by inserting each binder ring in a corresponding one of said recesses.

6. A binder as in claim 1 wherein:

said binder is formed of compressed paper;

said elongated spine is formed of plastic; and said annular rings are formed of plastic and are molded integrally with said elongated plastic spine.

7. A binder as in claim 1 wherein:

said binder, said elongated spine, and said annular rings are all formed of plastic; and said elongated plastic spine and said annular rings are molded as a single unit.

8. A binder as in claim 1 wherein each of said at least two binder rings further comprises:

an upper portion in the shape of a semicircle having first and second ends;

spaced parallel legs, each leg having an upper end and a lower end;

the upper end of each leg being integrally formed with one of said first and second ends of said semicircular upper portion; and the lower end of each leg being integrally formed with said elongated spine to form an interior area encompassed by said semicircular upper portion, said parallel legs, and said elongated spine.

9. A binder as in claim 8 wherein said interior area is an open area.

10. A binder as in claim 8 further including a center support integrally formed with said semicircular upper portion, said parallel legs, and said elongated spine, said center support having a width substantially identical to the smaller width of said second portion of said die-cut recesses, said center support providing break-resistant strength to said binder rings.

11. A binder as in claim 1 wherein said first portion of said die-cut recesses has the general shape of a wedge.

* * * * *